United States Patent [19]

Krogsrud

[11] 4,438,516

[45] Mar. 20, 1984

[54] MEANS FOR AN ELECTROTHERMAL SMELTING FURNACE

[75] Inventor: Harald Krogsrud, Gjettum, Norway

[73] Assignee: Elkem a/s, Oslo, Norway

[21] Appl. No.: 281,688

[22] Filed: Jul. 9, 1981

[30] Foreign Application Priority Data

Jul. 25, 1980 [NO] Norway ..... 802265

[51] Int. Cl.[3] ..... H05B 7/107

[52] U.S. Cl. ..... 373/97

[58] Field of Search ..... 373/96, 97, 89, 94, 373/100, 101

[56] References Cited

U.S. PATENT DOCUMENTS

| | | | |
|---|---|---|---|
| 1,686,302 | 10/1928 | Walther | 373/97 |
| 1,691,505 | 11/1928 | Walther | 373/97 |
| 1,735,936 | 11/1929 | Sem et al. | 373/97 |
| 1,774,674 | 9/1930 | Sem | 373/97 |
| 1,836,880 | 12/1931 | Sem | 373/97 |
| 2,193,434 | 3/1940 | Sem | 373/96 |
| 2,845,468 | 7/1958 | Haavik . | |

FOREIGN PATENT DOCUMENTS

| | | |
|---|---|---|
| 495737 | 4/1930 | Fed. Rep. of Germany . |
| 568927 | 1/1933 | Fed. Rep. of Germany . |
| 827382 | 1/1952 | Fed. Rep. of Germany . |
| 1052597 | 3/1959 | Fed. Rep. of Germany . |
| 1097058 | 1/1961 | Fed. Rep. of Germany . |
| 2121556 | 11/1972 | Fed. Rep. of Germany . |
| 2345865 | 9/1973 | Fed. Rep. of Germany . |
| 2312099 | 9/1974 | Fed. Rep. of Germany . |
| 808604 | 2/1937 | France . |

*Primary Examiner*—Roy N. Envall, Jr.

*Attorney, Agent, or Firm*—Eyre, Mann, Lucas & Just

[57] ABSTRACT

An improved holder assembly for self-baking electrodes in an electrothermal smelting furnace comprises a plurality of contact clamps which are pressed towards the electrode by hydraulic presses between the clamps and a surrounding cylindrical body arranged externally around the clamps. The holder assembly is further equipped with means for conducting current, coolant and/or pressure agent to the contact clamps. The contact clamps extend at least up to the zone where the raw, unbaked electrode paste is unaffected by the heat from the smelting furnace. The cylindrical body extends up from the area of the presses. The cylindrical body is slidably arranged with respect to the contact clamps. Each of the contact clamps is separately suspended and may be moved individually with respect to each other and with respect to the surrounding cylindrical body.

13 Claims, 4 Drawing Figures

MEANS FOR AN ELECTROTHERMAL SMELTING FURNACE

The present invention relates to a holder assembly which is, particularly, but not exclusively, suited for electrodes of the self-baking type in an electrothermal smelting furnace. The holder assembly is movably suspended from a suspension means. The holder assembly comprises a plurality of contact clamps which are pressed towards the electrodes by means of pressure producing means between them and an externally arranged thrust member or a pressure ring. The holder assembly is further equipped with means for conducting current, coolant and/or pressure agent to the contact clamps.

For assemblies of this type apparatus providing excellent electrical contact between the holder assembly and the electrode is required, the supplied current having to be as evenly distributed into the electrode as possible. Further, apparatus which enables a monitored and controlled slipping of the electrode is required in order to reduce the possibilities of uncontrolled slipping of the electrode. In addition, apparatus which is reliable in service, inexpensive and simple to maintain is required. For electrodes of the self-baking type, the electrode is surrounded by a metal casing so that tar or other volatile components of the electrode paste is prevented from uncontrolled escape into the surroundings during the baking.

In order to provide as good electrical contact as possible it has been proposed to use contact clamps which surround the electrode and which are pressed towards the electrode casing contact. Such conventional contact clamps have usually a vertical extension from 800–1000 mm. The so called pressure area of the contact clamps against the electrode lies in the lower half of each contact clamp, providing the highest contact pressure where the current is to be conducted to the electrode. The contact clamps are prevented from imposing radial forces onto the electrode at its upper end where the electrode paste is not yet baked.

The self-baking electrode, such as for example the famous "Söderberg"-electrode, consists of an iron casing which is filled with an electrode paste. The casing incorporates a plurality of ribs which contribute to the distribution of the current into the electrode paste to back the paste as the electrode is lowered down through the electrode holder assembly and down into the furnace. The electrode casing has to be liquid-tight so that volatile components such as tar are prevented from escaping out of the casing during the heating of the paste.

The conventional holder assembly as such functions satisfactorily. However, the conventional holder assembly is no longer competitive from a production and maintenance point of view. Further, the possibility of regulating and controlling the rate of baking and the position of the baking zone is limited. Further, the presence of the steel in the electrode casing causes certain problems with respect to production for example of Si-metals since the steel in the casing smelts and contaminates the produced metal.

The object of the present invention is to provide a self-baking electrode and a holder assembly for such electrode wherein a surrounding steel electrode casing is eliminated. A further object is to provide apparatus which is flexible in use and which by simple means may be adapted for use with different electrode systems.

According to the present invention this is achieved by using contact clamps which at least extend upward to the zone where the unbaked electrode paste is unaffected by the smelting heat from the furnace. Around the electrode, surrounding the contact clamps, a cylindrical body which extends upwards from the area of the contact clamps is arranged. Each of the contact clamps is slidably arranged on the internal surface of the cylindrical body. Each of the contact clamps is separately suspended and individually movable with respect to each other and with respect to the surrounding cylindrical body.

According to one embodiment, the cylindrical body extends upwards beyond the area where the unbaked electrode paste is unaffected by the heat from the furnace. The contact clamps and, optionally, the surrounding cylindrical body extend preferably up to a level which corresponds to the level where unbaked electrode paste is introduced into the electrode. Each of the contact clamps preferably has such lateral extension that the contact clamps completely surround the electrode and extend upwards in vertical direction to form a cylindrical body which completely surrounds the electrode and which is in close contact with the electrode.

According to a further embodiment of the present invention, the lower end of the surrounding cylindrical body terminates at a level just above the pressure producing means. The surrounding cylindrical body is freely supported by the contact clamps so that a vertical movement of one or more of the contact clamps will cause a corresponding movement of the surrounding cylindrical body.

The lateral extension of the lower part of the contact clamps preferably decreases in the downward direction. The decreasing portion starts preferably at the zone where the effect of the radially imposed contact pressure from the contact clamps may be considered to be negligible.

The surrounding cylindrical body and/or the contact clamps are equipped with cooperating means for guiding the movement of the contact clamps with respect to the surrounding cylindrical body. The guiding means may, for example, comprise a slot or a recess in the cylinder wall, into which a pin, bolt or similar means arranged on the clamping means may be slidably fit. According to one preferred embodiment, a liquid-tight foil is arranged on an inside of the contact clamps, the foil being intended to substitute for the conventional electrode casing of steel. The foil forms a cylindrical liquid-tight body which surrounds the electrode/electrode paste. The foil may for example be formed of aluminium, synthetic textile or similar known materials.

Thus, according to the present invention, each of the contact clamps has a length which corresponds substantially to the length of the electrode casing in a self-baking electrode, such as the famous "Söderberg"-electrode.

Each of the contact clamps is slidably suspended by suspension means such as, for example, a hydraulic cylinder. The suspension means may be activated separately and independently of each other or the activation may be synchronized. When one or more of the suspension means is activated, an individual motion of contact clamps upwards along the electrode may be achieved. For example a slipping rate of electrode in the order of 25 mm may be used in an electrode holder assembly consisting of 8 contact clamps. When one of the contact clamps is individually lifted by about 25 mm, the same effect as slipping the electrode a distance of 25 mm through the holder is achieved.

A dosage system which individually lifts any one contact clamp with respect to the remaining contact clamps, will, when linked to a computer, enable the operator to determine the position of the baking zone in the electrode. This may be achieved since the current which is imposed by the contact clamps to the electrode is the determining factor for the rate of baking. By moving one or more of the contact clamps upwards relative to the lower contact clamps which exert a pressure on the baked portion, operator may vary the rate of baking. The individual movement of the contact clamps surrounding the electrode opens up the possibility not hitherto available, for controlling of the baking condition of the electrode.

In a furnace where the electrode is arranged in a triangular position, uneven baking of the electrode often occurs due to the configuration of the electrode and the current conditions. Such uneven baking may produce detrimental thermic forces in the electrode. According to the present invention such detrimental effects may be completely eliminated since the contact clamps may be arranged in different and varying position.

According to the present invention, the contact clamps, preferably together with a foil replace the conventional electrode casing of steel. Each contact clamp is preferably a length of 5–6 meters. The inner surface of the extended contact clamps are machined and designed in such a way that they together form a cylinder which completely surrounds the electrode. The inner surface of said cylinder is machined to provide a smooth cylindrical surface having an internal diameter which substantially corresponds to the external diameter of the electrode. Each of the contact clamps are separately suspended and the movement is guided in vertical direction by means of a slot or a recess in the surrounding cylinder wall and corresponding taps, dowels, or the like on the clamps. Each of the contact clamps may be moved, for example, 250 mm upwards with respect to a contact clamp which has not yet been moved. The relative vertical motion of the surrounding body may also be, for example, a maximum of 250 mm. The contact clamp which at any time receives an impulse for moving upwards with respect to anyone of the remaining clamps may, independently from the remaining clamps, lift the surrounding cylinder the same length as the clamp itself moves.

According to the present invention the clamping means now serve the same function as the previously used electrode casing. Together the clamps form a cylinder and have sufficient mechanical strength to withstand pressure from the electrode paste. However, this cylinder is not liquid-tight. Therefore a liquid-tight foil of metal, synthetic textile or similar material should be used if steel casing is not used. A system of ribs of different design and extension may of course be used. It should be appreciated that the present invention also may be used on electrodes equipped with conventional electrode casing if this is desirable or necessary.

It should be appreciated however that the main purpose of the present invention is to provide a self-baking electrode which is independent of an electrode casing of steel.

The possibility of individual positioning of the contact to vary the position of clamps, the baking zone eliminates the necessity of radial ribs. When a liquid-tight foil of non-ferrous material, is used a self-baking electrode which is independent of steel is provided. This implies that furnaces producing Si-metal may be based on self-baking electrodes since the produced metal will not be contaminated by detrimental iron introduced through the casing. Further, it should be appreciated that the economy of furnace operation is greatly improved due to the "iron free" self-baking electrode.

One preferred embodiment of the present invention will now be described in further detail, referring to the drawings, wherein.

Figure 1:
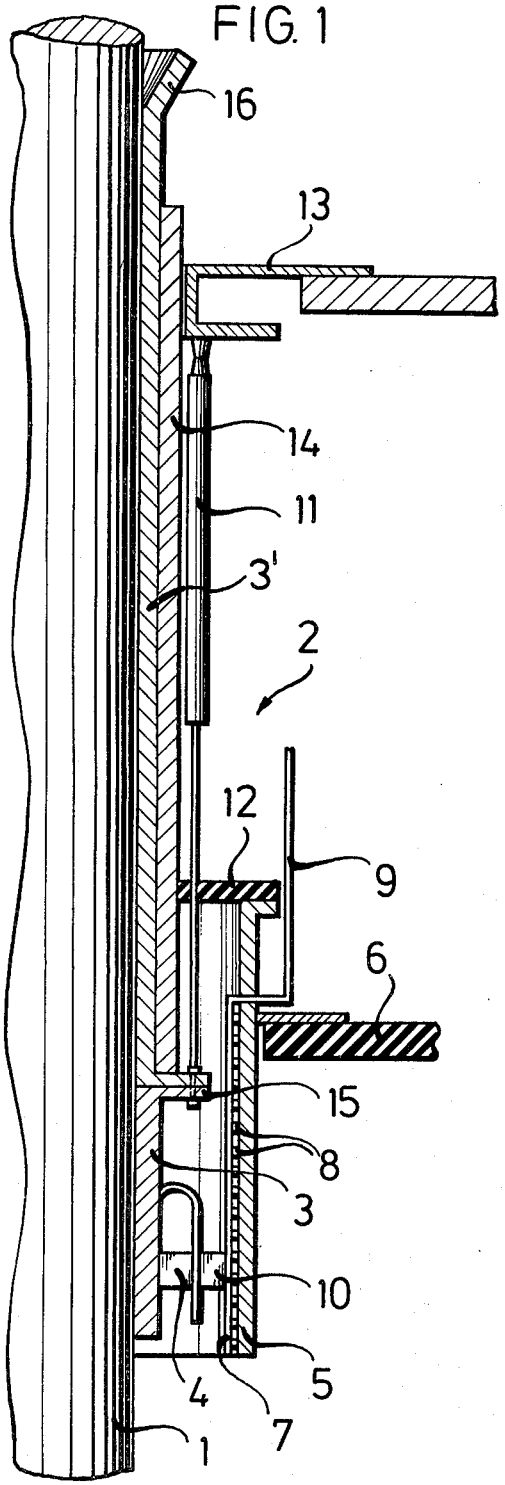
FIG. 1 shows a vertical section through a half of an electrode equipped with a holder assembly in accordance with the present invention.
Figure 2:
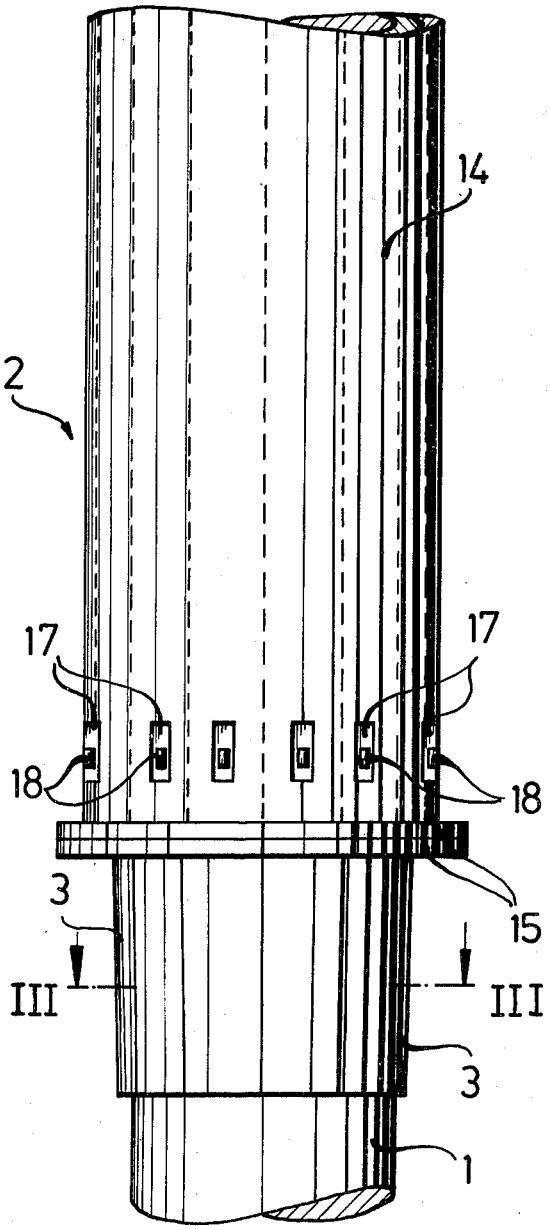
FIG. 2 shows a vertical elevation of an electrode with holder assembly.
Figure 3:
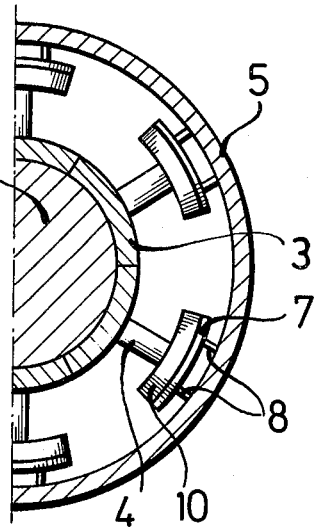
FIG. 3 shows a horizontal section through the electrode, the holder assembly and a cooling shield, seen along line III—III on FIG. 1.
Figure 4:
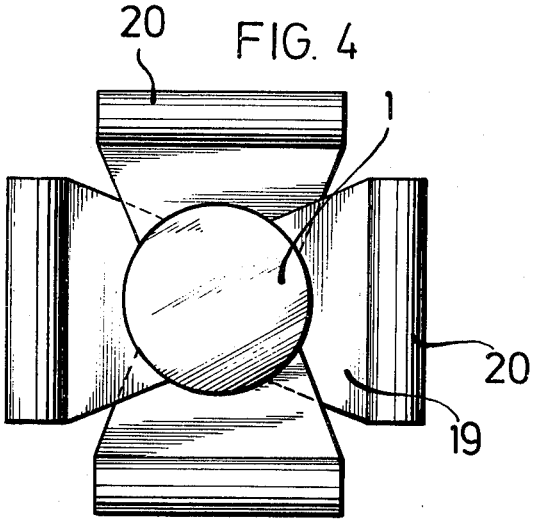
FIG. 4 shows a horizontal elevation of rolls of foils, arranged at the upper end of the electrode.

FIG. 1 shows a vertical section through one half of an electrode 1 with an electrode holder assembly 2. The electrode holder assembly 2 comprises a plurality of contact clamps evenly arranged around the entire periphery of the electrode. The contact clamps comprise a lower portion 3 and an upper portion 3', hereinafter generally referred to as contact clamps 3. The contact clamps 3 are pressed towards the electrode by pressure producing means 4 in order to provide sufficient electrical contact between the holder assembly and the electrode. As a thrust member for the pressure producing means 4, an externally arranged shield 5 surrounding the contact clamps and the electrodes in the region of the pressure producing means 4 is used. The shield 5 is stationary with respect to the electrode 1 and forms an integral part of the gas tight furnace roof or the smoke hood 6.

The cooling shield 5 has a vertical extension and is arranged in such a way with respect to the hood/roof that the shield 5 extends down into the furnace to a level which is below the level where the contact clamps 3 are intended to be moved during normal production.

A plurality of current conducting rails 7 are arranged vertically on the internal side of the cooling shield 5. The rails 7 are electrically insulated from the cooling shield 5 by insulating means indicated with the reference number 8. The rails 7 have a vertical extension which substantially corresponds to the distance over which the contact clamps 3 are intended to be moved during normal smelting operation. At its upper end the rails 7 are connected with the current supply net (not shown) by current communication rails 9. Current is conducted from the rails 7 to the contact clamps 3 through a sliding contact 10. The sliding contact 10 is activated by the pressure producing means 4. Consequently the contact clamps 3 and the sliding contact 10 receive the requisite contact pressure from the pressure producing means 4. The contact clamps 3 are suspended from a frame 13 by means of suitable suspension means 11 such as ties, rods, etc.

The contact clamps 3 and the pressure producing means 4 are equipped with supply pipes for supply of coolant and/or pressure agent. However, since this does not form a part of the present invention these constructional details are not shown on the figure. The upper end of cooling shield 5 is equipped with a gas tight sealing 12 arranged between the shield and the holder assembly 2.

The contact clamps 3 according to the present invention extend vertically at least up to the zone where the unbaked electrode paste is not affected by the heat from the smelting furnace. A cylindrical body 14 which extend vertically upward from the pressure producing means is arranged externally around the electrodes and surrounding the contact clamps 3. The contact clamps 3 slidably support the cylindrical body 14. Each of the contact clamps 3 is separately suspended by means of separate, independent suspension means 11. The contact clamps 3 may be individually moved with respect to each other and with respect to the surrounding cylindrical body 14. The contact clamps 3 and optionally the surrounding cylindrical body 8 extend preferably up to a level which corresponds to the level where unbaked electrode paste is supplied. The contact clamps 3 may preferably have such a lateral extension that the contact clamps together form a cylindrical body which completely surrounds the electrode and which has a predetermined vertical extension. The cylindrical body is arranged in close contact with the electrode. The surrounding cylindrical body 14 is freely supported by contact clamps 3, whereby a movement of one or more contact clamps 3 will cause a corresponding movement of the surrounding cylindrical body 14.

The lower part of the contact clamps 3 preferably decrease in lateral extension in the downwards direction. The decreasing section extends at least downwardly from the region where the contact clamps are unaffected by the radial forces caused by the pressure producing means. From a practical point of view the contact clamps 3 may preferably consist of an upper and a lower part, the two parts being interconnected through a flange 15 or the like by means of bolts etc. The flanges 15 serve preferably as support for the surrounding cylindrical body 14. At the upper end the upper portion of the contact clamps 3' are formed as a hopper 16.

In order to guide the movement of the contact clamps 3, the externally arranged cylindrical body 14 and/or the contact clamps 3 are provided with cooperating means for guiding the movement of contact clamps 3 with respect to the surrounding cylindrical body 14. A guiding means may for example comprise one or more slots, recesses etc. 17 in a wall of the cylindrical body 14 and a corresponding tap, bolt or the like 18 arranged on the contact clamps 3. The tap, bolt or the like 18 is intended to lie in slidable contact with the slot or recess 17 on the cylindrically shaped body 14.

Internally of the holder, between the elongate contact clamps 3 and the electrode 1, a liquid-tight foil 19 (not shown on FIG. 1) surrounding the electrode 1 may be arranged. The foil 19 may for example be formed of aluminium, synthetic textile or similar known material. The foil 19 is rolled up on rolls 20 arranged at a level of the upper end of the electrode. The number of foils 19 is dependent upon the widths of each foil and the diameter of the electrode. The foils 19 are intended to overlap each other. A foil may for example be welded together to provide a liquid-tight sleeve wherein raw electrode paste may be introduced.

As previously described each of the contact clamps 3 is slidably suspended by means of a suspension means 11 such as for example a hydraulic cylinder. The suspension means 11 may be activated separately or together as a unit. By activating one or more of the suspension means 11 an individual movement of each of the contact clamps upwards or downwards along the electrode may be achieved. A slipping length of the electrode through the electrode holder of 25 mm may for example be used when an holder assembly incorporating eight contact clamps 3 is used. When one of the contact clamps 3 is lifted 25 mm individually, such lifting will cause the same effect as if the electrode has been slipped 25 mm through the holder. A contact which at any time is moved upwards with respect to anyone of the remaining clamps 3, will independently of the other clamps 3 lift the surrounding cylinder 14 the same length as the contact clamp 3 itself is lifted.

I claim:

1. A holder assembly for self-baking electrodes of an electrothermal smelting furnace, said electrode hving a baking zone for baking unbaked electrode paste introduced above the baking zone, comprising:

(a) a plurality of contact clamps comprising upper and lower portions, said contact clamps extending upwardly at least to a level above said baking zone where the unbaked electrode paste is not affected by heat from the furnace;

(b) a surrounding cylindrical body arranged externally about said upper portion of said contact clamps;

(c) a thrust member arranged externally about said lower portion of said contact clamps;

(d) pressure producing means disposed between said thrust member and said contact clamps for pressing said contact clamps toward the electrode; and (e) at least one contact clamp being individually suspended and slidable with respect to the other said contact clamps and said cylindrical body.

2. The holder assembly of claim 1 wherein the contact clamps extend upwardly to a level corresponding to the level where said unbaked electrode paste is introduced.

3. The holder assembly of claim 2 wherein the cylindrical body extends upwardly to the level where electrode paste is introduced.

4. The holder assembly of claim 1 wherein the lower end of the surrounding cylindrical body is just above the pressure producing means.

5. The holder assembly of claim 1 wherein the surrounding cylindrical body is freely supported by the contact clamps whereby a vertical movement of one or more of the contact clamps can result in a corresponding movement of the surrounding cylindrical body.

6. The holder assembly of claim 1 wherein the lateral dimensions of the contact clamps are such that together they form a vertically-extending, divided cylinder which completely surrounds the electrode.

7. The holder assembly of claim 6 wherein the lateral dimensions of the lower portion part of each of the contact clamps decreases downwardly.

8. The holder assembly of claim 7 wherein the decreasing part of the contact clamps extends at least from the area where the effect of the radially imposed contact pressure from the contact clamps is negligible.

9. The holder assembly of claim 1 further comprising guiding means for guiding the direction of movement of the contact clamps with respect to the surrounding cylindrical body.

10. The holder assembly of claim 9 wherein the guiding means comprises a slot in the wall of the surrounding cylindrical body and a tap, bolt or similar means arranged on the contact clamps, said tap, bolt or similar means being in slidable relationship with the slot in the cylindrical wall.

11. The holder assembly of claim 1 wherein a liquid-tight foil is arranged between the contact clamps and the electrode, the foil surrounding the electrode.

12. A holder assembly for self-baking electrodes of an electrothermal smelting furnace comprising:

(a) a plurality of contact clamps having upper and lower portions, said contact clamps having a predetermined vertical extension and predetermined lateral dimensions such that together said contact clamps form a vertically-extending, divided cylinder surrounding an electrode space adapted for receiving and baking an electrode paste therein:

(b) a cylindrical body arranged externally about the upper portions of said contact clamps in sliding abutment therewith;

(c) a cooling shield, said cooling shield including means operative to act as a thrust member;

(d) pressure producing means disposed between said contact clamps and said cooling shield for forcing the lower portion of said contact clamps toward said electrode space; and (e) at least one said contact clamp being individually suspended and vertically slidable with respect to the other said contact clamps and said cylindrical body.

13. The holder assembly of claim 12 further comprising means for providing a gas and liquid-tight foil onto the interior surface at the upper portion of the divided cylindrical body whereby a substantially gas and liquid-tight seal is achieved between the contact clamps and the electrode as the electrode paste is carried downwardly toward the furnace.

* * * * *